US008313325B2

(12) United States Patent
Sen-Yu

(10) Patent No.: US 8,313,325 B2
(45) Date of Patent: Nov. 20, 2012

(54) IGNITION SWITCH OF GAS STOVE

(75) Inventor: Wu Sen-Yu, Taichung Hsien (TW)

(73) Assignee: Seven Universe Industrial Co., Ltd., Taichung County (TW)

( * ) Notice: Subject to any disclaimer, the term of this patent is extended or adjusted under 35 U.S.C. 154(b) by 897 days.

(21) Appl. No.: 11/976,726

(22) Filed: Oct. 26, 2007

(65) Prior Publication Data

US 2008/0227042 A1 Sep. 18, 2008

Related U.S. Application Data

(63) Continuation-in-part of application No. 10/922,902, filed on Aug. 23, 2004, now abandoned.

(51) Int. Cl.
*F23Q 1/00* (2006.01)

(52) U.S. Cl. ..... 431/254; 126/39 E; 137/66

(58) Field of Classification Search ..... 431/254; 126/39 E; 137/66, 614.11; 251/11, 129.03
See application file for complete search history.

(56) References Cited

U.S. PATENT DOCUMENTS

| | | | | |
|---|---|---|---|---|
| 2,850,030 | A * | 9/1958 | Guelson | 137/66 |
| 4,543,974 | A * | 10/1985 | Dietiker et al. | 137/66 |
| 5,979,484 | A * | 11/1999 | Grando et al. | 137/66 |
| 6,234,189 | B1 * | 5/2001 | Koch | 137/66 |
| 6,886,581 | B2 * | 5/2005 | Harniet | 137/66 |

* cited by examiner

*Primary Examiner* — Alfred Basichas
(74) *Attorney, Agent, or Firm* — Ming Chow; Sinorica, LLC

(57) ABSTRACT

The present invention provides an ignition switch, which includes a switch member, a closed device, a knob, an electromagnetic valve, and a driving device. The switch member has a receiving chamber to receive the driving device therein. The driving device connects the knob and the electromagnetic valve such that the electromagnetic valve is operated by manipulation of the knob.

2 Claims, 8 Drawing Sheets

IGNITION SWITCH OF GAS STOVE

This is a continuation-in-part application of Ser. No. 10/922,902 filed on Aug. 23, 2004 now abandoned.

BACKGROUND OF THE INVENTION

1. Field of the Invention

The present invention relates generally to a gas stove and more particularly to an ignition switch of the gas stove.

2. Description of the Related Art

A conventional ignition switch mounted in a gas stove has a closed device and an electromagnetic valve. While user turns a knob of the stove, it drives a shaft of the closed device pushing a plug of the electromagnetic valve for gas flowing to a burner of the stove for burning. After that, a heater, which electrically connects the electromagnetic valve, generates current to activate the electromagnetic valve according to the heat of the burner.

In the conventional ignition switch, the electromagnetic valve is arranged next to the closed device, so that the ignition switch has a greater length. As a result, the stove has to provide sufficient length in height or in width to receive the ignition switch. In other words, the conventional ignition switch makes the stove large.

For an improved ignition switch, the electromagnetic valve is arranged perpendicular to the closed device to reduce the length thereof. Typically, there are two types of that. First, a coupler is provided to connect the shaft of the closed device and the plug of the electromagnetic valve. The plug of the electromagnetic valve is activated by the shaft of the closed device via the coupler while the knob is turned. The ignition switch has to change the orientation of the gas channel, so that the switch is totally different from the conventional switch and that increases the cost. Second, a transmission device is provided to connect the knob and the electromagnetic valve. The electromagnetic valve is activated by the knob via the transmission device. The transmission device is installed independently that might be easy to be impacted and damaged in assembly. There is no ignition switch in the present market without any drawback.

SUMMARY OF THE INVENTION

The primary objective of the present invention is to provide an ignition switch of a gas stove, which the gas channel is kept as the conventional one and the transmission device will not be impacted and the length of the switch is decreased.

According to the objectives of the present invention, an ignition switch includes a switch member, a closed device, a knob, an electromagnetic valve, and a driving device. The switch member has a base, in which a cone valve, a receiving chamber, a gas bore communicated with the valve chamber and the receiving chamber, and a gas inlet communicated with the receiving chamber are provided, a main flame tube connected to valve chamber of the base, a receiving tube connected to the receiving chamber of the base with a check port therebetween, and a cap on the base and corresponding to the valve chamber. The closed device is received in the valve chamber of the base. The knob is provided on the cap and connected to the closed device. The electromagnetic valve is received in the receiving tube with a gate to seal and open the check port. The driving device includes a driving member, a pushing member and a transmission member. The driving member is connected to the knob. The pushing member is received in the receiving chamber and against the gate of the electromagnetic valve. The pushing member has at least a channel to communicate the check port and the gas bore. The transmission member is operated for reciprocation to connect the driving member and the pushing member. When the knob is pressed, the driving member moves the pushing member through the transmission member so that the pushing member moves the gate of the electromagnetic valve to open the check port for gas flowing to the valve chamber through the channel of the pushing member and the gas bore.

DETAILED DESCRIPTION OF THE INVENTION

Figure 1:
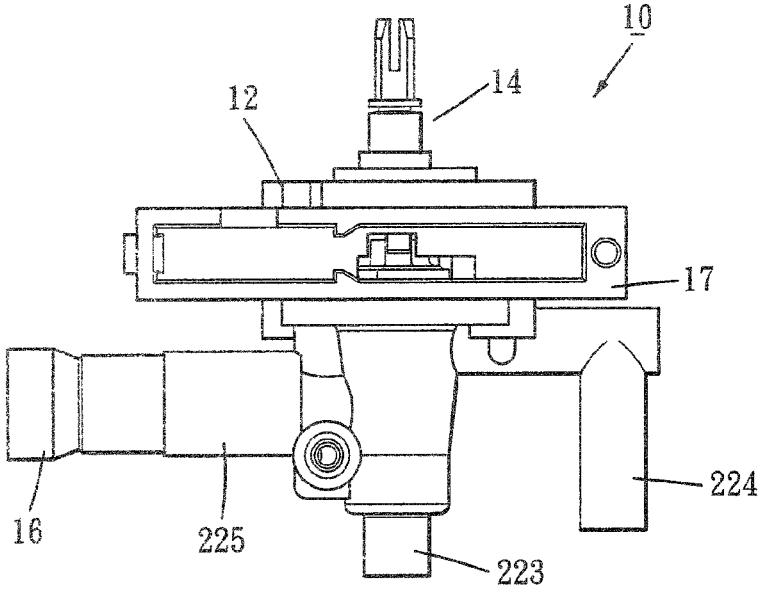
FIG. 1 is a front view of a first preferred embodiment of the present invention.
Figure 2:
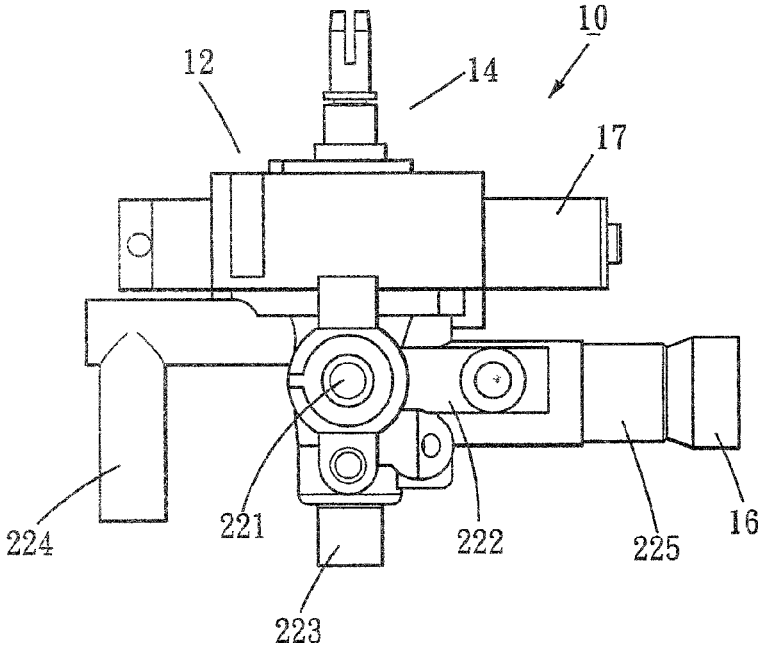
FIG. 2 is a rear view of the first preferred embodiment of the present invention.
Figure 3:
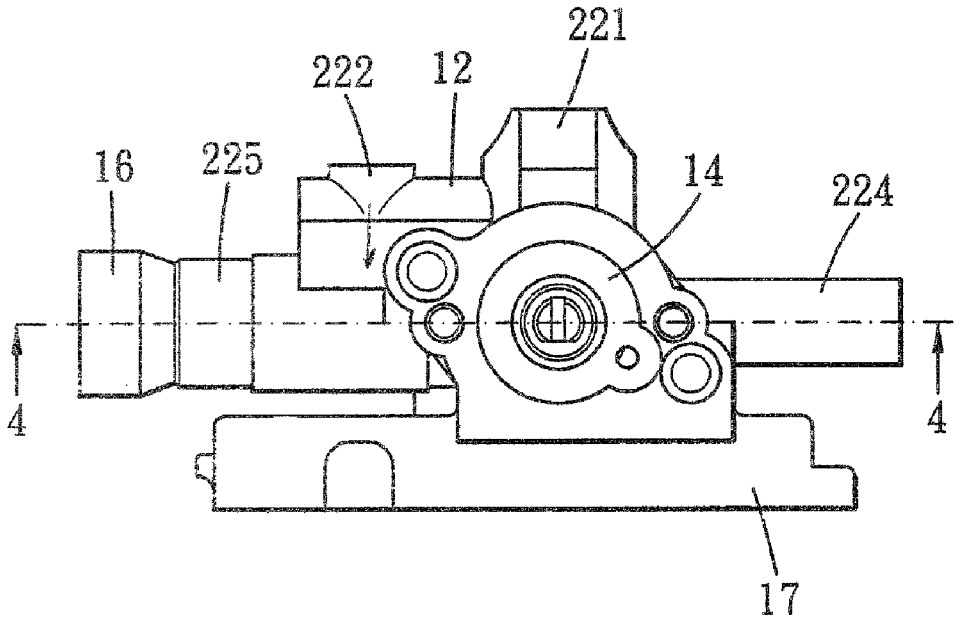
FIG. 3 is top rear view of the first preferred embodiment of the present invention.
Figure 4:
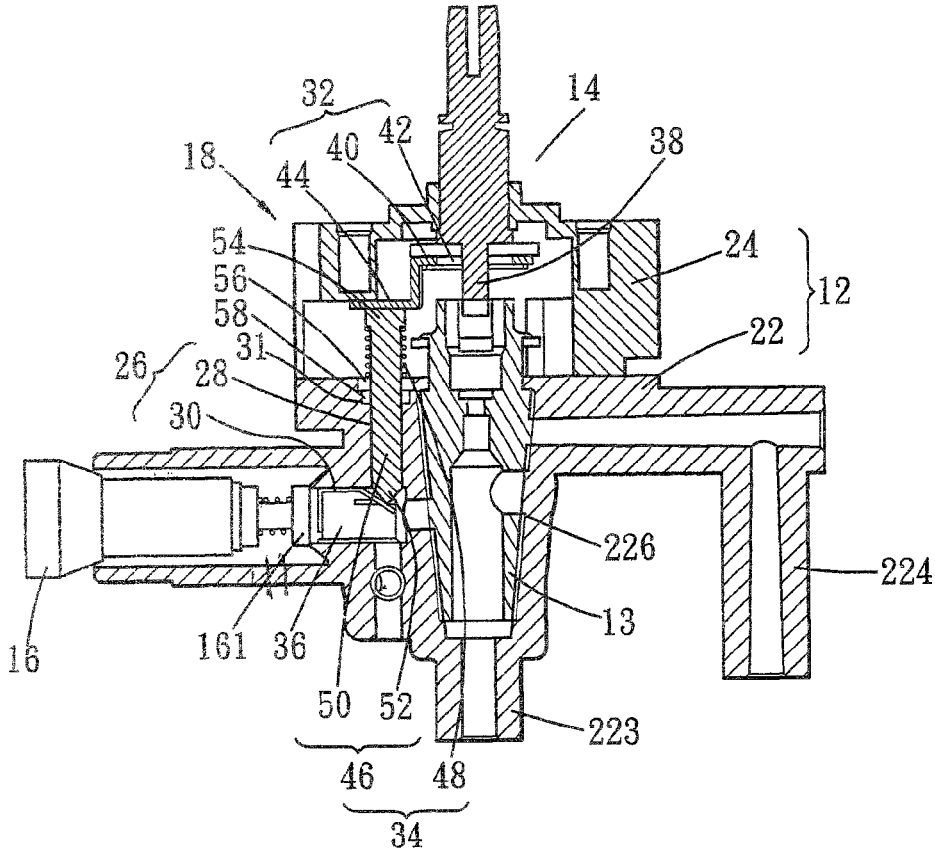
FIG. 4 is a sectional view along the 4-4 line of FIG. 3.
Figure 5:
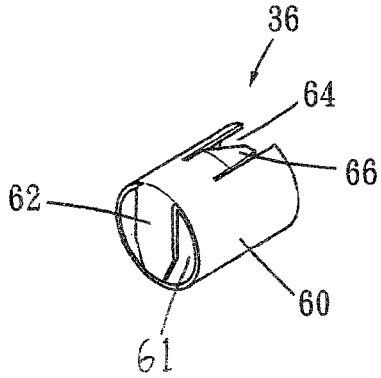
FIG. 5 is perspective view of the pushing member of the first preferred embodiment of the present invention.

As shown in FIG. 1 to FIG. 5, an ignition switch 10 of the first preferred embodiment of the present invention comprises a switch member 12, a closed device 13 in the switch member 12, a knob 14 at an end of the switch member 12 to drive the closed device 13, an electromagnetic valve 16 beside the switch member 12 and an ignition device 17. These elements are as same as the conventional one, so I'll not describe the detail. The characters of the present invention are described hereunder:

The switch member 12 has a base 22 and a cap 24. The base 22 has a base body 221, a main flame tube 222, a mother flame tube 223, a receiving tube 224, a cone valve chamber 225, a receiving chamber 226, a gas bore 227 communicated with one of the chambers 225 and 226, and a gas inlet 228. The valve chamber 225 is communicated with the main flame tube 222 and the mother flame tube 223. The receiving chamber 226 has a first chamber 229 and a second chamber 230 communicated with each other. The first chamber 229 is communicated with the cap 24, and the second chamber 230 is communicated with the gas bore 227 and the receiving tube 224. Between the second chamber 230 and the gas bore 227 is a check port 23. The first chamber 230 is provided with an order bore 232 on a sidewall thereof. The base 22 further has a chamber 26, which has a first chamber 28 on a top thereof, a second chamber 30 communicated with the first chamber 28 and the valve chamber 225 and an order hole 31 communicated with the first chamber 28. The closed device 13 is mounted in the receiving chamber 226, the electromagnetic valve 16 is mounted in the valve chamber 225 and the knob 14 is mounted on the cap 24.

The closed device 13, the knob 14, the electromagnetic valve 16, and the ignition device 17 are as same as the conventional devices. The closed device 12 is received in the valve chamber 225. The knob 14 and the ignition device 17 are mounted on the cap 24. The electromagnetic valve 16 is received in the receiving tube 224 with a gate 161 sealing and opening the check port 231.

The switch 10 of the present invention further comprises a driving device 18 mounted in the chamber 26, which has a driving member 32, a transmission member 34 and a pushing member 36.

The driving member 32 has a main member 40 on which a hole 42 is provided to fit a shaft 38 of the knob 13 and a pressing portion 44 projected from the main member 40.

The transmission member 34 has a beam 46 and an elastic device 48. The shaft 46 is inserted in the first chamber 28 having a post 50, a first block 52 at a bottom end of the post 50 and a second block 54 at a top end of the post 50 to be connected to the pressing portion 44. The elastic device 48 is a spring 48 fitted to the post 50 between the second block 54 and a pad plate 56 mounted in the order hole 31. An O-ring is mounted in the order hole 31 connected to a bottom thereof. The O-ring 58 is fitted to the post 50 to prevent gas from leakage out of the first chamber 28.

The pushing member 36 is received in the second chamber 30 having a barrel-like base portion 60, in which a channel 61 is provided, a pushing portion 62, a plug 161 on the base portion 60 to be connected to the electromagnetic valve 16, a positioning portion 64, which is a slot, and an inclined stop portion 66 in the positioning portion 64. The first block 52 of the beam 46 is connected to the stop portion 66 and is restricted by the positioning portion 64, so that the first block 52 is restricted between the stop portion 66 and the positioning portion 64.

Figure 6:
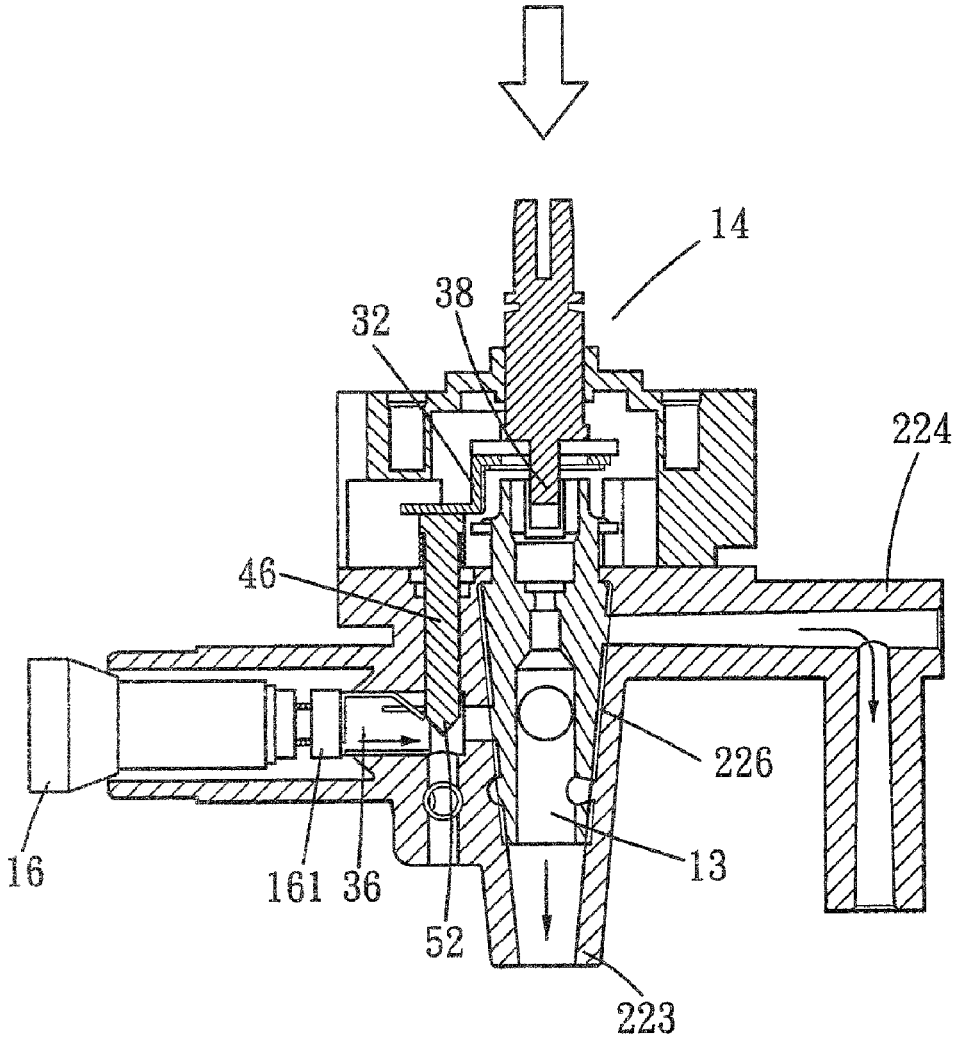
FIG. 6 is a sectional view of the first preferred embodiment of the present invention, showing the motion of the driving device.
Figure 7:
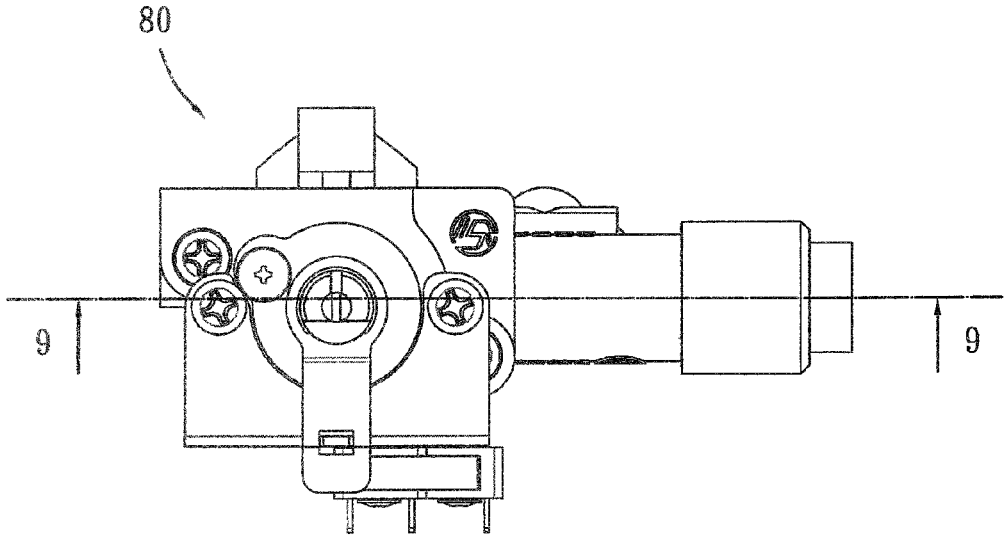
FIG. 7 is top rear view of the second preferred embodiment of the present invention.
Figure 8A:
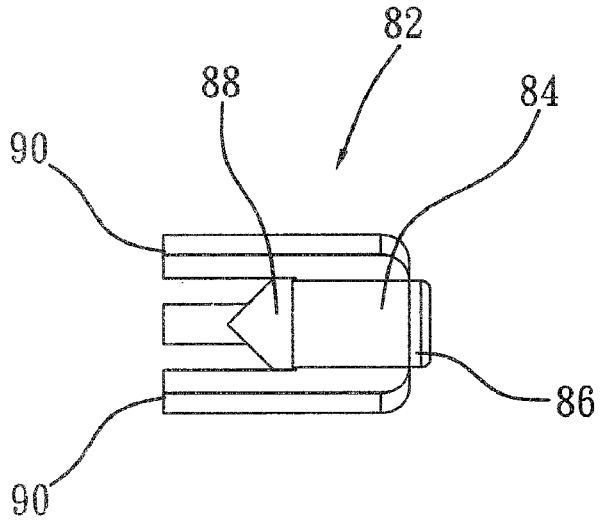
FIG. 8A is side view of the pushing member of the second preferred embodiment of the present invention.
Figure 8B:
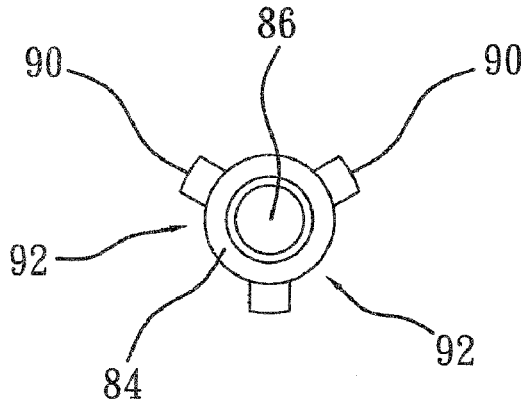
FIG. 8B is end view of the pushing member of the second preferred embodiment of the present invention.
Figure 9:
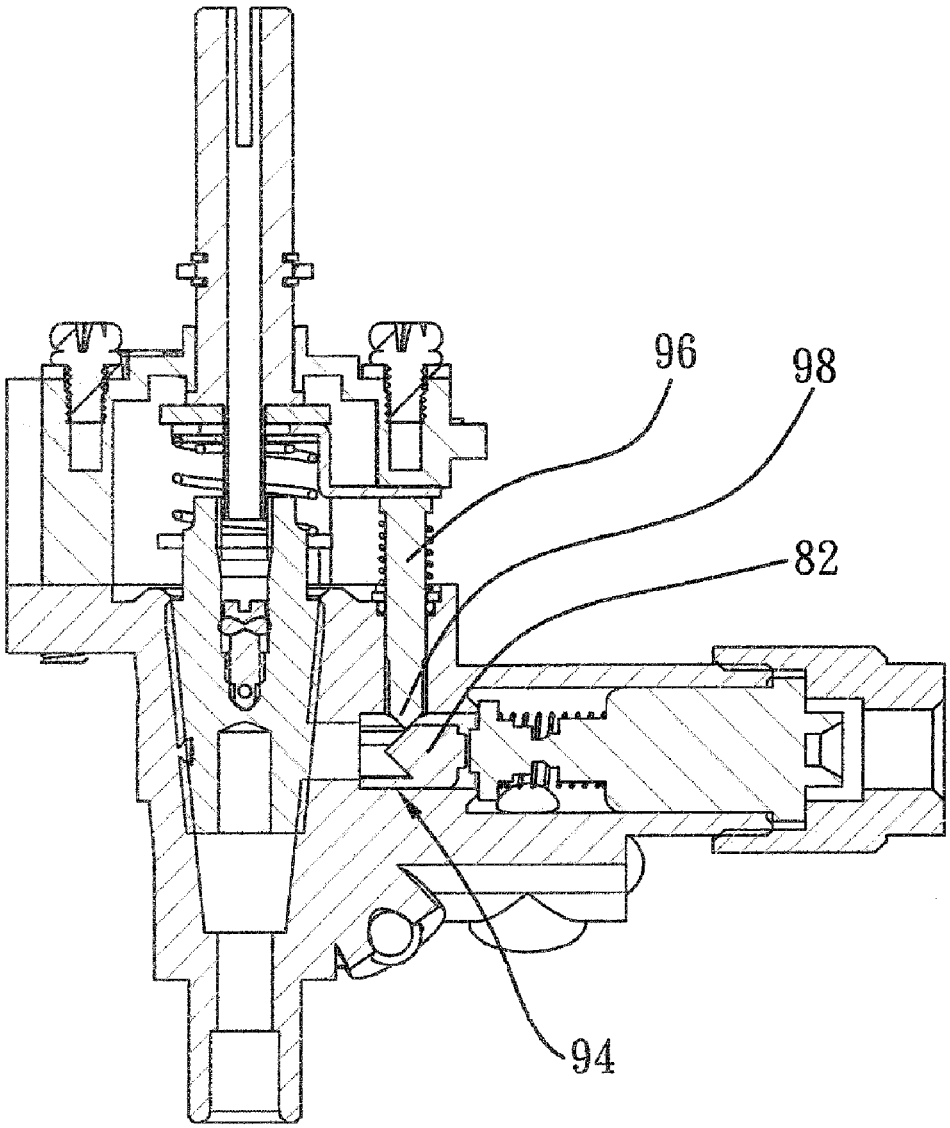
FIG. 9 is a sectional view along the 9-9 line of FIG. 8.
Figure 10:
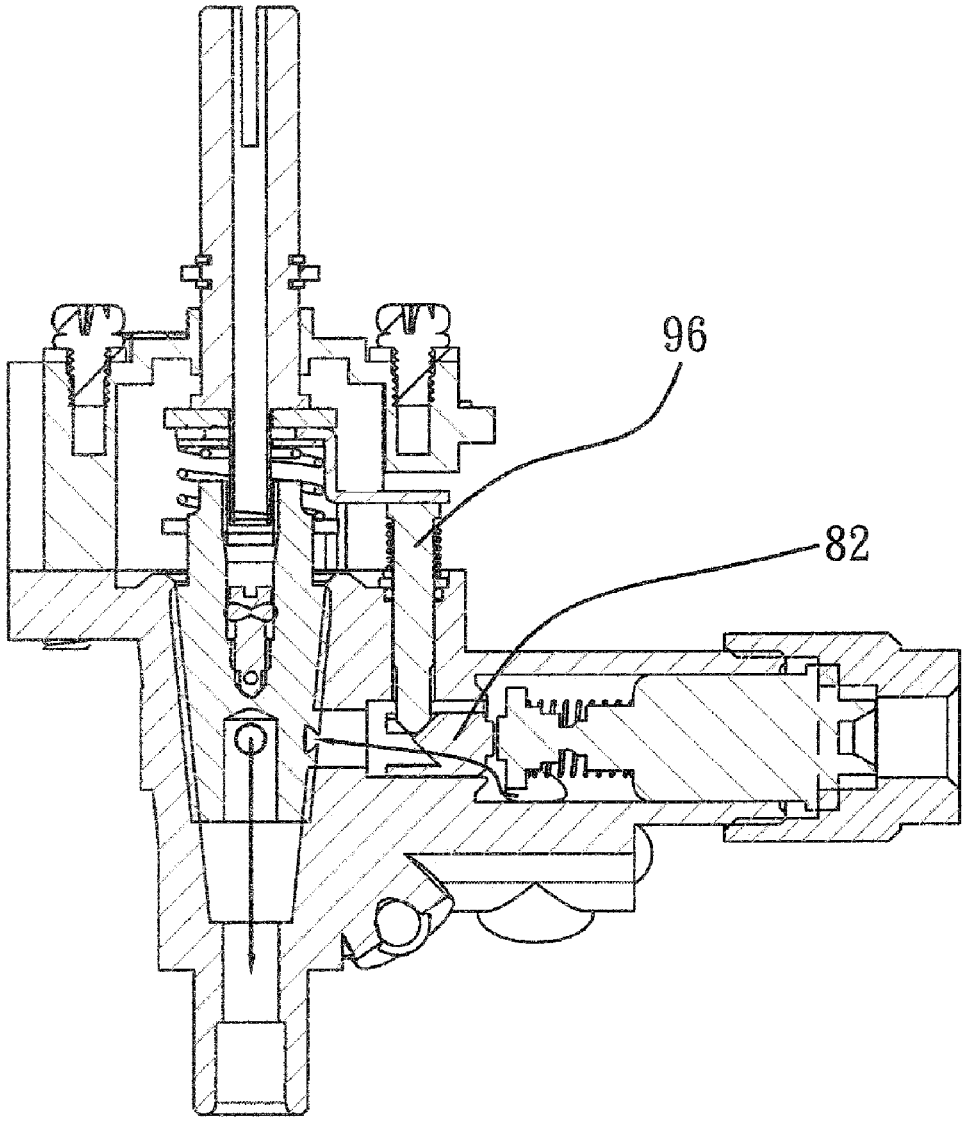
FIG. 10 is a sectional view of the second preferred embodiment of the present invention, showing the motion of the driving device.

As shown in FIG. 6, while the knob 14 is pressed, the shaft 38 is moved downward to drive the beam 46 of the transmission member 34 downward. In the meantime, the first block 52 of the beam 46 pushes the pushing member 36 to activate the electromagnetic valve 16 for gas flowing to a burner of the stove through the channel 61 of the pushing member 36, a gas bore 227, the valve chamber 225, the main flame tube 222 and the mother flame tube 223. While the knob 14 is moved back to its original position, the shaft 38 is moved upward and the elastic device 48 forces the beam 46 and the driving member 32 upward. As a result, the pushing member 36 is moved back by the gate 161 to its original portion by the electromagnetic valve 16.

The ignition switch 10 of the present invention, under a circumstance of not changing the gas channel of the conventional ignition switch, provides the chamber 26 and the driving device 18 in the switch member 12 and beside the closed device 13 to control the electromagnetic valve 16. To compare with the conventional ignition switch as described above, the ignition switch 10 of the present invention has a shorter length, which helps the stove to decrease the size thereof and to use the space in the stove more flexible.

As shown in FIG. 7 to FIG. 10, it provides an ignition device 80 of the second preferred embodiment of the present invention, which is similar to the ignition device 10 as discussed above, except that there is no ignition device in this embodiment. Beside that, a pushing device 82 has a base portion 84, which is a post, a pushing portion 86 and a stop portion 88 are a block and a cone block on the base portion 84, and a positioning portion 90 including a plurality of ribs projected from an outer side of the base portion 84 to an outer end of the stop portion 88. Between the positioning portion 90 and a base portion 84 is a plurality of channel 92. Therefore, the pushing device 82 has the positioning portion 90 against an interior wall of the second chamber 94. The area of the positioning portion 90 against the second chamber 94 is smaller than that of the pushing device 36 and the interior wall of the second chamber 94 as discussed above that the motion of the pushing device will be smooth. The stop portion 88 and the first block 98 of the transmission device 96 are complementary that the motions of both are smooth too. Each of the channels provides a better flow of gas than the channel 61 as discussed above.

In conclusion, the ignition switch of the present invention still applies the conventional switch member and the electromagnetic valve under the circumstance of not changing the gas channel of the conventional ignition switch and has a shorter length, which helps the stove to decrease the size thereof and to use the space in the stove more flexible. In addition, the present invention prevents the transmission device form being impacted and damaged.

What is claimed is:

1. An ignition switch, comprising:

a switch member comprising a base;

the base comprising a base body, a main flame tube, a mother flame tube, a receiving tube, a cone valve chamber, a receiving chamber, a gas bore, and a gas inlet;

a main flame tube connected to valve chamber of the base;

a receiving tube connected to the receiving chamber of the base with a check port therebetween;

a cap on the base corresponding to the valve chamber;

a closed device mounted in the receiving chamber;

a knob provided on the cap and connected to the closed device;

an electromagnetic valve mounted in the valve chamber with a gate to seal and open the check port;

a driving device including a driving member, a pushing member and a transmission member;

the driving member connected to the knob;

the pushing member, which has at least a channel to communicate the check port and the gas bore, being received in the electromagnetic valve chamber and against the gate of the electromagnetic valve;

the transmission member being operated for reciprocation to connect the driving member and the pushing member;

wherein when the knob is pressed, the driving member moves the pushing member through the transmission member so that the pushing member moves the gate of the electromagnetic valve to open the check port for gas flowing to the valve chamber through the channel of the pushing member and the gas bore;

the receiving chamber includes a first chamber and a second chamber communicated with each other;

the transmission device being received in the first chamber;

the pushing member is received in the second chamber;

the transmission member having a beam with an end thereof being received in the receiving chamber and an end thereof being connected to the driving member;

an elastic device being mounted between the end the beam connected to the driving member and an interior wall of the switch member;

the beam having a post;

a first block on an end of the post being connected to the pushing member;

a second block on an end of the post to be connected to the driving member;

the pushing member has a base portion;

a pushing portion on the base portion facing the electromagnetic valve;

a stop portion on the base portion being connected to the first block of the transmission member;

a positioning portion on the base portion keeping the first block of the transmission member in touch with the stop portion;

the base portion of the pushing member being a tubular member;

the positioning portion being a slot;

the stop portion being a bent plate and being received in the position portion;

the pushing portion being a bent plate on a tail end of the base portion; and the channel is in the base portion.

2. An ignition switch, comprising:

a switch member comprising a base;

the base comprising a base body, a main flame tube, a mother flame tube, a receiving tube, a cone valve chamber, a receiving chamber, a gas bore, and a gas inlet;

a main flame tube connected to valve chamber of the base;

a receiving tube connected to the receiving chamber of the base with a check port therebetween;

a cap on the base corresponding to the valve chamber;

a closed device mounted in the receiving chamber;

a knob provided on the cap and connected to the closed device;

an electromagnetic valve mounted in the valve chamber with a gate to seal and open the check port;

a driving device including a driving member, a pushing member and a transmission member;

the driving member connected to the knob;

the pushing member, which has at least a channel to communicate the check port and the gas bore, being received in the electromagnetic valve chamber and against the gate of the electromagnetic valve;

the transmission member being operated for reciprocation to connect the driving member and the pushing member, wherein when the knob is pressed, the driving member moves the pushing member through the transmission member so that the pushing member moves the gate of the electromagnetic valve to open the check port for gas flowing to the valve chamber through the channel of the pushing member and the gas bore;

the receiving chamber includes a first chamber and a second chamber communicated with each other;

the transmission device being received in the first chamber;

the pushing member is received in the second chamber;

the transmission member having a beam with an end thereof being received in the receiving chamber and an end thereof being connected to the driving member;

an elastic device being mounted between the end the beam connected to the driving member and an interior wall of the switch member;

the beam having a post;

a first block on an end of the post being connected to the pushing member;

a second block on an end of the post to be connected to the driving member;

the pushing member has a base portion;

a pushing portion on the base portion facing the electromagnetic valve;

a stop portion on the base portion being connected to the first block of the transmission member;

a positioning portion on the base portion keeping the first block of the transmission member in touch with the stop portion;

the pushing portion being a block;

the stop portion being a cone block;

the positioning portion comprising a plurality of ribs being projected from the base portion to an outer end of the stop portion; and the positioning portion and the base portion comprising a plurality of the channels on surfaces thereof.

* * * * *